US008851194B2

(12) United States Patent
Ford et al.

(10) Patent No.: US 8,851,194 B2
(45) Date of Patent: Oct. 7, 2014

(54) SEAL WITH BELLOWS STYLE NOSE RING

(76) Inventors: David L. Ford, Houston, TX (US); Daniel C. Benson, Spring, TX (US); Leonard Landriault, Houston, TX (US)

( * ) Notice: Subject to any disclaimer, the term of this patent is extended or adjusted under 35 U.S.C. 154(b) by 537 days.

(21) Appl. No.: 13/114,916

(22) Filed: May 24, 2011

(65) Prior Publication Data

US 2012/0247788 A1 Oct. 4, 2012

Related U.S. Application Data

(60) Provisional application No. 61/468,979, filed on Mar. 29, 2011.

(51) Int. Cl.
*E21B 33/04* (2006.01)

(52) U.S. Cl.
CPC ..... *E21B 33/0422* (2013.01)
USPC ..... 166/387; 166/85.3; 166/368; 277/626; 277/647

(58) Field of Classification Search
USPC ..... 166/368, 387, 85.3; 277/607, 626, 644, 277/647, 530
See application file for complete search history.

(56) References Cited

U.S. PATENT DOCUMENTS

| | | | | |
|---|---|---|---|---|
| 3,649,032 A | | 3/1972 | Nelson | |
| 4,702,481 A | * | 10/1987 | Brammer | 277/328 |
| 4,751,965 A | * | 6/1988 | Cassity | 166/182 |
| 4,949,787 A | * | 8/1990 | Brammer et al. | 166/208 |
| 5,067,734 A | | 11/1991 | Boehm, Jr. | |
| 5,456,314 A | | 10/1995 | Boehm, Jr. et al. | |
| 6,182,755 B1 | * | 2/2001 | Mansure | 166/180 |
| 7,748,467 B2 | * | 7/2010 | Doane | 166/387 |
| 2010/0116489 A1 | | 5/2010 | Nelson | |
| 2010/0147533 A1 | | 6/2010 | Nelson | |
| 2010/0300705 A1 | | 12/2010 | Nelson | |
| 2011/0174506 A1 | * | 7/2011 | Duong | 166/387 |

FOREIGN PATENT DOCUMENTS

| | | |
|---|---|---|
| EP | 2354441 A2 | 8/2011 |
| GB | 2375575 A | 11/2002 |
| GB | 2462520 A | 2/2010 |

OTHER PUBLICATIONS

GB Search Report dated Jul. 20, 2012 from corresponding Application No. GB1205498.7.

* cited by examiner

*Primary Examiner* — Nicole Coy

(57) ABSTRACT

A seal assembly between a wellhead housing having a bore and a casing hanger, has an inner seal leg for sealing against hanger and an outer seal leg for sealing against housing. An extension extends downward from outer seal leg and has a downward facing shoulder that rests on an upward facing shoulder formed on a nose ring. Connection connects seal ring to the nose ring with a lower portion of the nose ring resting on the upward facing shoulder of the casing hanger. Bellows are formed on the nose ring to increase lockdown capacity. Bellows have an inner surface that faces an outer profile of the hanger, and an outer surface on the bellow that faces the bore of the housing. When the bellows are axially collapsed, they expand radially outward and contract radially inward into the bore of the housing and the outer profile of the hanger.

17 Claims, 4 Drawing Sheets

SEAL WITH BELLOWS STYLE NOSE RING

CROSS-REFERENCE TO RELATED APPLICATION

This application claims priority to provisional application 61/468,979 filed Mar. 30, 2011.

FIELD OF THE INVENTION

This invention relates in general to wellhead assemblies and in particular to a seal nose ring that improves lockdown to a casing hanger.

BACKGROUND OF THE INVENTION

Seals are used between inner and outer wellhead tubular members to contain internal well pressure. The inner wellhead member may be a casing hanger located in a wellhead housing and that supports a string of casing extending into the well. A seal or packoff seals between the casing hanger and the wellhead housing. Alternatively, the inner wellhead member could be a tubing hanger that supports a string of tubing extending into the well for the flow of production fluid. The tubing hanger lands in an outer wellhead member, which may be a wellhead housing, a Christmas tree, or a tubing head. A packoff or seal seals between the tubing hanger and the outer wellhead member.

A variety of seals located between the inner and outer wellhead members have been employed in the prior art. Prior art seals include elastomeric and partially metal and elastomeric rings. Prior art seal rings made entirely of metal for forming metal-to-metal seals ("MS") are also employed. The seals may be set by a running tool, or they may be set in response to the weight of the string of casing or tubing. One type of prior art metal-to-metal seal has seal body with inner and outer walls separated by a cylindrical slot, forming a "U" shape. An energizing ring is pushed into the slot in the seal to deform the inner and outer walls apart into sealing engagement with the inner and outer wellhead members, which may have wickers formed thereon. The energizing ring is typically a solid wedge-shaped member. The deformation of the seal's inner and outer walls exceeds the yield strength of the material of the seal ring, making the deformation permanent.

Thermal growth between the casing or tubing and the wellhead may occur, particularly with wellheads located at the surface, rather than subsea. The well fluid flowing upward through the tubing heats the string of tubing, and to a lesser degree the surrounding casing. The temperature increase may cause the tubing hanger and/or casing hanger to move axially a slight amount relative to the outer wellhead member. During the heat up transient, the tubing hanger and/or casing hanger can also move radially due to temperature differences between components and the different rates of thermal expansion from which the component materials are constructed. If the seal has been set as a result of a wedging action where an axial displacement of energizing rings induces a radial movement of the seal against its mating surfaces, then sealing forces may be reduced if there is movement in the axial direction due to pressure or thermal effects. A reduction in axial force on the energizing ring results in a reduction in the radial inward and outward forces on the inner and outer walls of the seal ring, which may cause the seal to leak. A loss of radial loading between the seal and its mating surfaces due to thermal transients may also cause the seal to leak. One approach to preventing this type of movement is through the use of lockdown C-rings on the seal that rest in a machined pocket on the energizing ring. The C-ring engages the hanger when the seal is set, locking the seal to the hanger. Another approach has been to use the sealing element itself as a locking mechanism. In these approaches, lockdown is thus provided by the seal. Further, a lockdown style hanger may be utilized to lock the casing hanger in place. This requires an extra trip to lower the lockdown style hanger.

A need exists for a technique that addresses the seal leakage problems described above by providing additional lockdown capacity in a cost-effective way. The following technique may solve one or more of these problems.

SUMMARY OF THE INVENTION

In an embodiment of the present invention, a seal assembly is located between a wellhead housing having a bore and a casing hanger. The housing is typically located at an upper end of a well and serves as an outer wellhead member. The casing hanger has an upward facing shoulder for supporting a lower portion of the seal assembly. A metal-to-metal seal assembly has an inner seal leg with an inner wall sealing against the cylindrical wall of casing hanger and an outer seal leg with an outer wall surface that seals against wellhead housing bore. The seal legs form a U-shaped pocket or slot. An extension extends downward from the outer seal leg and may have a threaded connection. However, it is not necessary that the connection be threaded. The extension has a downward facing shoulder that rests on an upward facing shoulder formed on a nose ring. The connection connects the seal ring to the nose ring with a lower portion of the nose ring resting on the upward facing shoulder of the casing hanger to provide a reaction point during setting operations. In this embodiment, a plurality of bellows are formed on the nose ring to advantageously increase lockdown capacity of the seal assembly. The bellows may be formed in a helical shape and have an inner surface that faces an outer profile of the hanger, and an outer surface on the bellows that faces the bore of the housing. Each of the bellows may have legs that form a "V" or "U" shape with gaps formed between the outer surfaces of the bellows. Similarly, gaps are formed between the inner surfaces of the bellows. When the seal assembly is set, the bellows will collapse, reducing a width of the gaps as the bellows expand inward and outward into the outer profile of the hanger and the bore of the housing.

The bellows on the nose ring provide a mechanism of locking down the hanger in addition to those in the prior art. Thus, lockdown capacity is advantageously increased by sharing upward forces on the hanger among the present invention and these mechanisms of the prior art. In addition, the present invention may also advantageously save the time and money associated with having to re-trip in order to install a lockdown hanger.

DETAILED DESCRIPTION OF THE INVENTION

Figure 1:
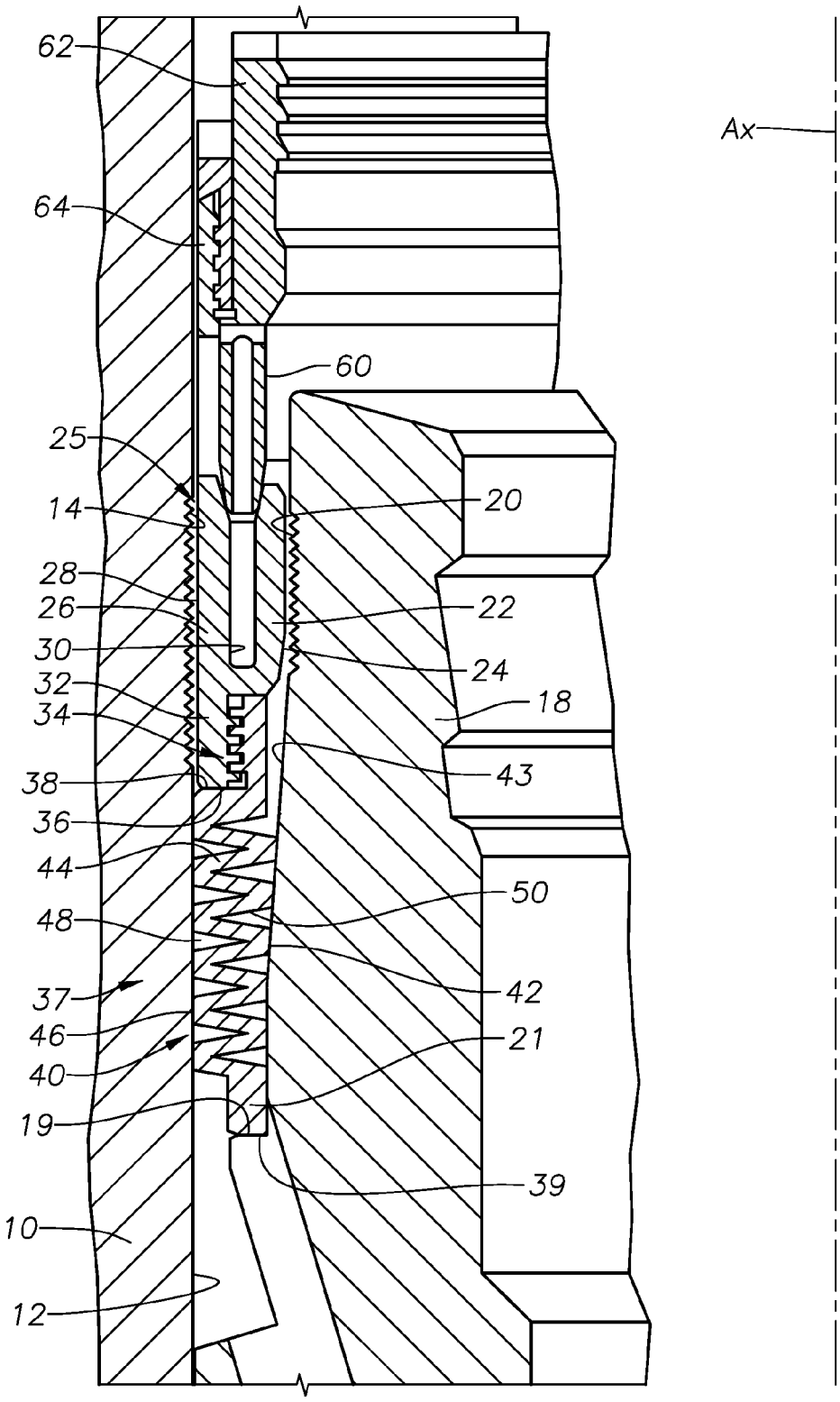
FIG. 1 is a sectional view of a seal assembly with an energizing ring locked to the seal, but unset, in accordance with an embodiment of the invention.

Referring to FIG. 1, an embodiment of the invention shows a portion of the high pressure wellhead housing or outer wellhead member 10. A portion of a seal assembly is shown between the wellhead housing 10 having a bore 12 with wickers 14 formed thereon and a casing hanger or inner wellhead member 18 with wickers 20 formed on an exterior portion. The seal assembly is shown in an unset position in FIG. 1. Housing 10 is typically located at an upper end of a well and serves as an outer wellhead member 10. In this embodiment, the casing hanger 18 has an upward facing shoulder 19 for supporting a lower portion 21 of the seal assembly. A metal-to-metal seal assembly has an inner seal leg 22 with and inner wall 24 sealing against the cylindrical wall of casing hanger 18. Seal ring 25 has an outer seal leg 26 with an outer wall surface 28 that seals against wellhead housing bore 12. The wall surfaces 24, 28 may be cylindrical and smooth. The seal legs 22, 26 form a U-shaped pocket or slot 30.

Figure 2:
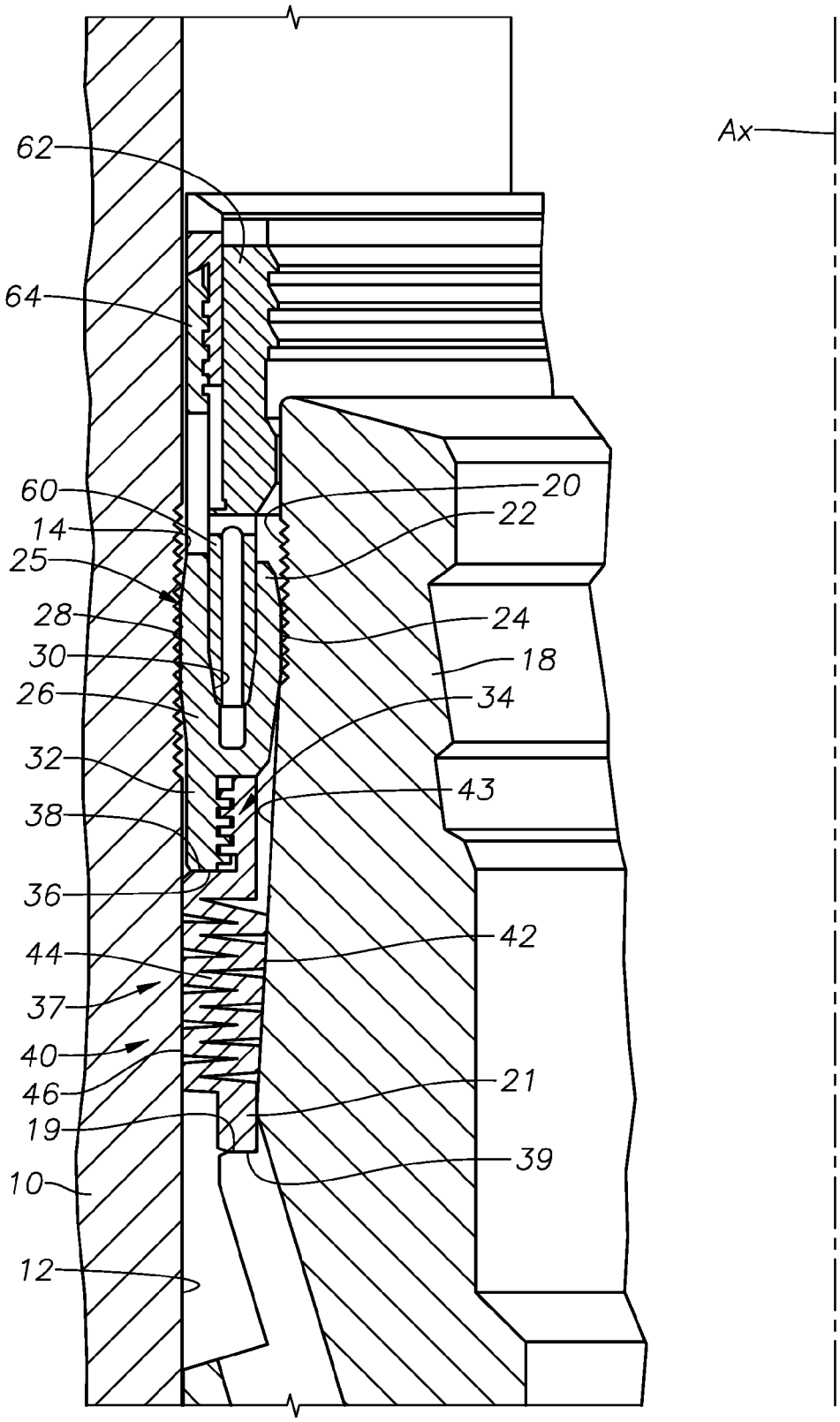
FIG. 2 is a sectional view of the seal assembly of FIG. 1 between outer and inner wellhead members in the set position, in accordance with an embodiment of the invention.

An extension 32 extends downward from the outer leg 26 and may have a threaded connection 34. However, it is not necessary that the connection be threaded. The extension 32 has a downward facing shoulder 36 that rests on an upward facing shoulder 38 formed on a nose ring 37. The threaded connection 34 connects the seal ring 25 to the nose ring 37. A lower portion 39 of the nose ring rests on the upward facing shoulder 19 of the casing hanger 18 to provide a reaction point during setting operations. In this embodiment, a plurality of bellows 40 are formed on the nose ring 37 to increase lockdown capacity of the seal assembly. The bellows 40 may be formed in a helical shape. The bellows 40 have an inner surface 42 that faces an outer profile 43 of the hanger 18. In this embodiment, the outer profile 43 has a slight taper, however, the outer profile 43 may also be formed without taper. An outer surface 46 on the bellow 40 faces the bore 12 of the housing 10. A bellows thickness from inner to outer surfaces 42, 46 of the bellows 40 may vary as the inner surface 42 follows the taper of the outer profile 43 of the hanger 18. Each of the bellows may have undulation 44 that form a "V" or "U" shape. Gaps 48 are formed between the outer surfaces 46 of the bellows 40. Similarly, gaps 50 are formed between the inner surfaces 42 of the bellows 50. The gaps may be between 0.010 to 0.75 inches before setting. When the seal assembly is set, as shown in FIG. 2, the bellows 40 will collapse, reducing a width of the gaps 48 (FIG. 1) as the bellows 40 expand inward and outward into the outer profile 43 of the hanger 18 and the bore 12 of the housing 10. Bellows 40 is formed of metal.

The bellows 40 on the nose ring 37 provide a mechanism of locking down the hanger 18 in addition to those in the prior art.

Continuing to refer to FIG. 1, an energizing ring 60 is typically forced downward by a running tool (not shown) or the weight of a string (not shown) to force it into the slot 30 of the seal ring 25. An upper portion 62 of the energizing ring 60 allows threaded connection to the running tool or string. An outer nut 64 keeps the assembly of the energizing ring 60 together during assembly and operations. The energizing ring 60 deforms the inner and outer seal legs 22, 26 of the seal ring 25 against the outer wellhead member 10 and the inner wellhead member 18.

During setting operation, the seal assembly, including the seal ring and nose ring 37, is landed on the upward facing shoulder 19 of the hanger 18. The seal assembly is located between the hanger 18 and housing 10. The energizing ring 60 is forced downward by the running tool or the weight of the string. The reaction point formed between the upward facing shoulder 19 of the hanger 18 and the downward facing shoulder 39 of the nose ring 37 allow the force applied on the energizing ring 60 to move energizing ring into the slot 30 of the seal ring 25. When the energizing ring 60 moves into the pocket 30, it deforms the inner and outer seal legs 22, 26 of the seal ring 25 against the housing 10 and the hanger 18. The force applied via the energizing ring 60 also axially collapses and radially expands the outer diameter of bellows 40. The inner diameter of bellows 40 contracts radially. The inner surface 42 of the bellows 40 contacts the outer profile 43 of the hanger 18 and the outer surface 46 of the bellows 40 contacts the bore 12 of the housing 10. The radial distance from the inner diameter to the outer diameter of bellows 40 when fully axially contracted is greater than the radial distance from hanger profile 43 to wellhead housing bore 12.

This engagement by the expanded bellows 40 with the hanger 18 and housing 10 provides a rigid stop for the seal assembly, allowing the seal to be fully set, as shown in FIG. 2. Once set, any additional upward force on the hanger 18 is transmitted into the bellows 40 of the nose ring 37, increasing radial force and friction into the outer profile 43 of the hanger 18 and bore 12 of the housing 10, thus providing greater lockdown capacities to the hanger 18 and preventing the sealing element 25 from being exposed to the full forces from the hanger 18 and casing (not shown). The design of the nose ring 37 with bellows 40 also accommodates the situation of landing high due to debris on the hanger 18. The surfaces of bellows 40 that contact hanger profile 18 and housing bore 12 do not form seals.

Further, force from the bellows 40 of the nose ring 37 may be sufficient to deform the outer profile 43 of the hanger 18 or bore 12 of the housing 10. In such cases, this will further increase lockdown capacities.

Figure 3:
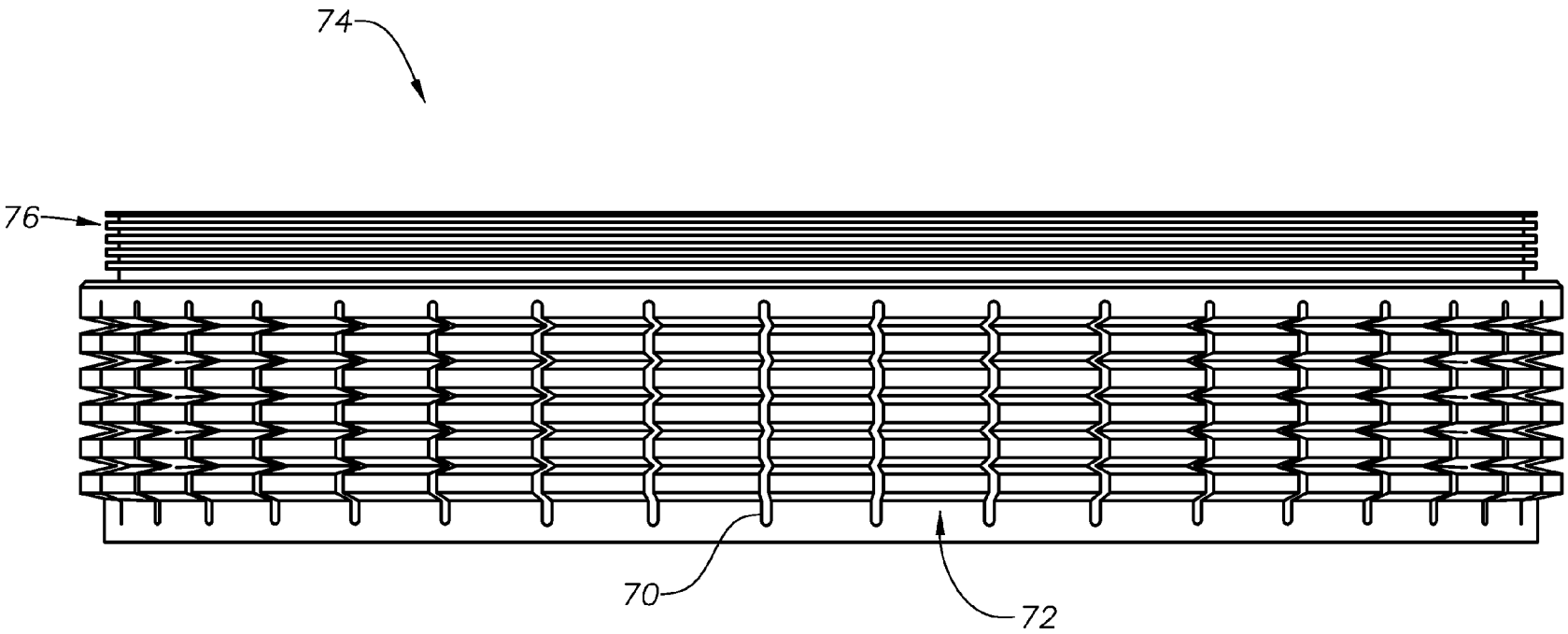
FIG. 3 is a front view of a lock ring with bellows, in accordance with an embodiment of the invention.

In another embodiment shown in FIG. 3, cuts or slots 70 may be formed on bellows 72 formed on nose ring 74, in an axial direction. Alternatively, slots 70 may be formed on bellows 72 on nose ring 74, in a slanted direction. This nose ring 74 is threadingly connected to the seal ring 26 (FIG. 1) via a threaded connection 76. The slots 70 make the structure of the bellows 72 non-continuous. The slots 70 aid in the lockdown function of the nose ring 74 by facilitating the collapse and aiding in thermal expansion of the bellows 72.

In another embodiment, the bellows 40 portion of the nose ring 37 may be made of a material with a different coefficient of thermal expansion than the hanger 18 and housing 10 that allow bellows 40 to thermally expand at a greater rate, thus adding to its lockdown capacities.

Figure 4:
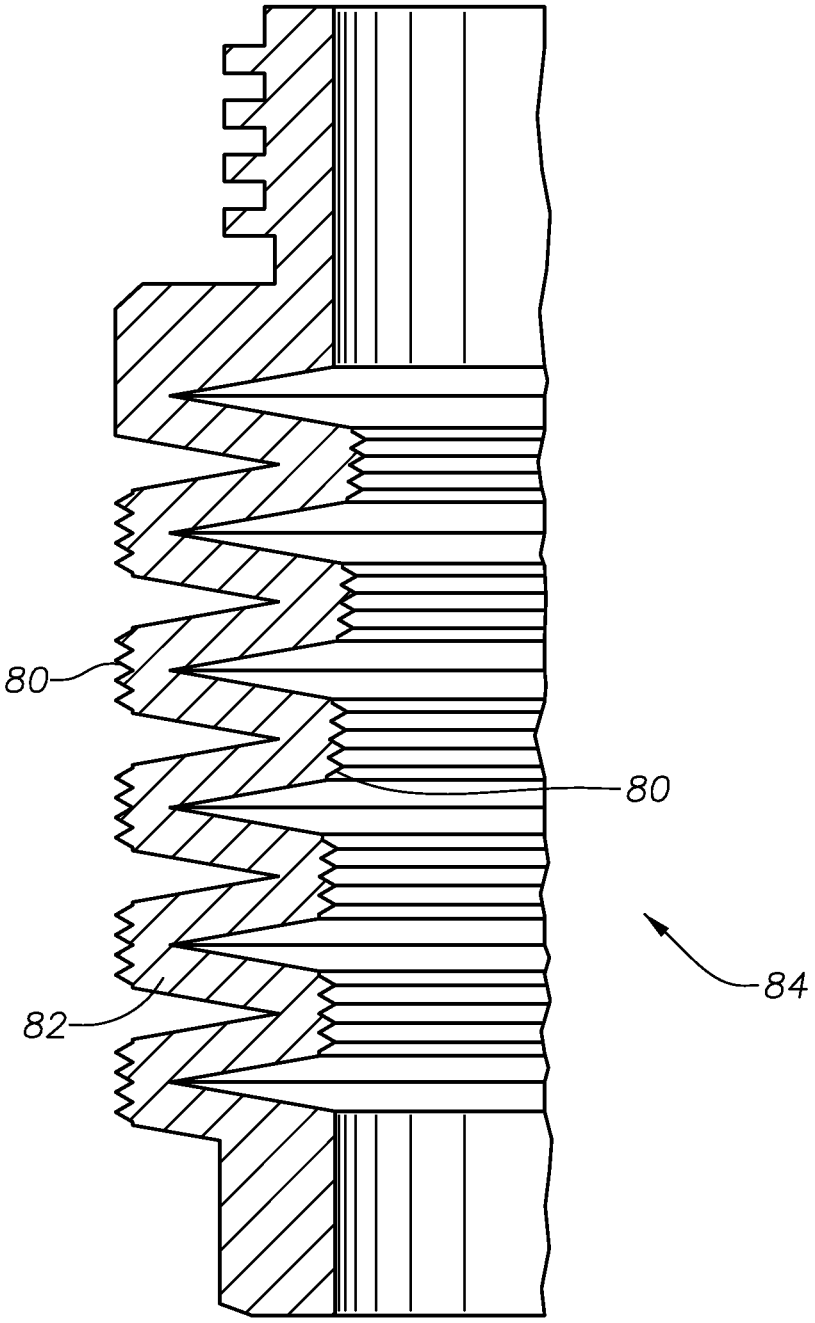
FIG. 4 is a sectional view of bellows with teeth, in accordance with an embodiment of the invention.

In yet another embodiment shown in FIG. 4, teeth 80 may be formed on bellows 82 formed on a nose ring 84. The teeth 80 aid in the lockdown function by digging into the bore 12 of the housing 10 (FIG. 1) and the outer profile 43 of the hanger 10 (FIG. 1). Thus, lockdown capacity is advantageously increased by sharing upward forces on the hanger 18 among the present invention and these mechanisms of the prior art. In addition, the present invention may also save the time and money associated with having to re-trip in order to install a lockdown hanger. Further, with the present invention there is no need for additional locator grooves in the housing, thus allowing for greater misalignment during operation.

This written description uses examples to disclose the invention, including the best mode, and also to enable any person skilled in the art to practice the invention, including making and using any devices or systems and performing any incorporated methods. These embodiments are not intended to limit the scope of the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A wellhead assembly with an axis, comprising:

an outer wellhead member having a bore;

an inner wellhead member located in the bore;

a seal ring between and in sealing engagement with the inner and outer wellhead members, wherein the seal ring has an inner annular member and an outer annular member circumscribing a portion of the inner annular member, a bellows on a lower end of the seal ring, the bellows having undulations that meet at a point and form gaps at an opposite end of the undulations and being axially contractible, the undulations having outer surfaces that expand outward radially into the outer wellhead member and inner surfaces that contract radially inward into the inner wellhead member; and an annular energizing ring having a lower end insertable between the inner and outer annular members of the seal ring, so that when the lower end of the energizing ring is inserted between the inner and outer annular members of the seal ring, outer walls of the inner and outer annular members of the seal ring are urged radially apart into sealing engagement with the inner and outer wellhead members.

2. The assembly according to claim 1, further comprising:

an annular extension extending downwards and located below the seal ring, the annular extension having a downward facing lower surface;

an annular nose ring connected to the annular extension, the nose ring having an upward facing shoulder in contact with the lower surface of the annular extension and having a lower surface for landing on a portion of the inner wellhead member.

3. The assembly according to claim 2, wherein the bellows are formed on the nose ring in a helical shape.

4. The assembly according to claim 2, wherein the nose ring is connected to the annular extension via a threaded connection formed between the annular extension and an upward extension of the nose ring.

5. The assembly according to claim 2, wherein the inner wellhead member comprises a shoulder projecting radially outward to allow the lower surface of the annular nose ring to land, the shoulder providing a reaction point during setting operations.

6. The assembly according to claim 1, wherein the bellows comprise undulations that meet at a point and form gaps at an opposite end of the undulations, the gaps in the bellows exist prior to setting, the gaps diminishing when the bellows collapses during setting.

7. The assembly according to claim 1, wherein slots are formed on the bellows and extend from a lower end to an upper end of the bellow to facilitate collapse of bellows during setting operations.

8. The assembly according to claim 1, wherein a set of teeth is formed on at least one of the bellow inner and outer diameter surfaces.

9. The assembly according to claim 1, wherein in an axially contracted condition, a radial distance from an inner diameter to an outer diameter of the bellows is greater than a radial distance between the inner annular member and the outer annual member.

10. A wellhead seal assembly, comprising:

a seal ring for location and sealing between inner and outer wellhead members, wherein the seal ring has an inner annular member and an outer annular member circumscribing a portion of the inner annular member;

a bellows on a lower end of the seal ring, the bellows being axially contractible, having outer surfaces and inner surfaces; wherein the bellows comprise undulations that meet at a point and form gaps at an opposite end of the undulations, the gaps in the bellows exist prior to setting, and the gaps diminish when the bellows axially contract during setting; and a lower end of the bellows is adapted to land on a shoulder of the inner wellhead member and when seal ring is energized, the undulations axially contract and expand outward into the outer wellhead member and inward into the inner wellhead member; and an annular energizing ring having a lower end insertable between the inner and outer annular members of the seal ring, so that when the lower end of the energizing ring is inserted between the inner and outer annular members of the seal ring, outer walls of the inner and outer annular members of the seal ring are urged radially apart into sealing engagement with the inner and outer wellhead members.

11. The assembly according to claim 10, further comprising:

an annular extension extending downwards and located below the seal ring, the annular extension having a downward facing lower surface;

an annular nose ring connected to the annular extension, the nose ring having an upward facing shoulder in contact with the lower surface of the annular extension and having a lower surface for landing on a portion of the inner wellhead member.

12. The assembly according to claim 11, wherein the nose ring is connected to the annular extension via a threaded connection formed between the annular extension and an upward extension of the nose ring.

13. The assembly according to claim 10, wherein the bellows are in a helical shape.

14. The assembly according to claim 10, wherein slots are formed on the bellows and extend from a lower end to an upper end of the bellow to facilitate collapse of bellows during setting operations.

15. The assembly according to claim 10, wherein a set of teeth is formed on at least one of the bellows inner and outer diameter surfaces.

16. The assembly according to claim 10, wherein in an axially contracted condition, a radial distance from an inner diameter to an outer diameter of the bellows is greater than a radial distance between the inner annular member and the outer annual member.

17. A method for sealing an inner wellhead member to an outer wellhead member, comprising:

providing a seal assembly having a bellows carried on a lower end, the bellows having undulations that meet at a point and form gaps at an opposite end of the undulations;

providing teeth on one of the surface of the undulations and driving the teeth into engagement with one of the inner and outer wellhead members;

landing and setting the seal assembly between the inner and outer wellhead members;

in response to setting the seal assembly, expanding the outer surface of the undulations outward into the outer wellhead member;

contracting inner surfaces of the undulations inward into the inner wellhead member.

* * * * *